US007963469B2

(12) United States Patent
Hanson

(10) Patent No.: US 7,963,469 B2
(45) Date of Patent: Jun. 21, 2011

(54) WATER RECYCLING FOOD WASTE DISPOSER SYSTEM

(75) Inventor: Steven P. Hanson, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 333 days.

(21) Appl. No.: 12/028,855

(22) Filed: Feb. 11, 2008

(65) Prior Publication Data

US 2008/0191070 A1 Aug. 14, 2008

Related U.S. Application Data

(60) Provisional application No. 60/901,184, filed on Feb. 13, 2007.

(51) Int. Cl.
*B02C 23/36* (2006.01)

(52) U.S. Cl. ..... 241/46.013; 241/97

(58) Field of Classification Search ..... 241/46.013–46.017, 97, 80
See application file for complete search history.

(56) References Cited

U.S. PATENT DOCUMENTS

| | | | | |
|---|---|---|---|---|
| 3,048,340 | A * | 8/1962 | Vernon | 241/46.06 |
| 3,695,519 | A | 10/1972 | Bebinger | |
| 3,801,998 | A | 4/1974 | Macias | |
| 3,875,462 | A | 4/1975 | Kiefer et al. | |
| 4,135,258 | A | 1/1979 | Braga et al. | |
| 5,308,000 | A | 5/1994 | Riley | |
| 5,533,681 | A * | 7/1996 | Riley | 241/56 |
| 6,007,006 | A | 12/1999 | Engel et al. | |
| 6,135,374 | A | 10/2000 | Hansen et al. | |
| 6,276,005 | B1 | 8/2001 | Sanders et al. | |
| 6,439,487 | B1 | 8/2002 | Anderson et al. | |
| 6,648,252 | B2 | 11/2003 | Strutz | |
| 6,854,673 | B2 | 2/2005 | Strutz et al. | |
| 7,100,850 | B2 | 9/2006 | Farmerie | |
| 7,360,729 | B2 * | 4/2008 | Anderson et al. | 241/46.013 |
| 2003/0226918 | A1 | 12/2003 | Gerstel | |
| 2004/0173697 | A1 | 9/2004 | Berger et al. | |
| 2006/0032951 | A1 | 2/2006 | Berger et al. | |

(Continued)

FOREIGN PATENT DOCUMENTS

JP 2001-179116 7/2001

(Continued)

OTHER PUBLICATIONS

Written Opinion of the International Search Authority for PCT/US/001784.

*Primary Examiner* — Faye Francis
(74) *Attorney, Agent, or Firm* — Harness, Dickey & Pierce, P.L.C.

(57) ABSTRACT

A food waste disposer having a fluid recycling device includes a plate disposed for rotation within the food waste disposer. At least one fluid recovery member connects a first side of the plate defining a food grinding cavity to a second side of the plate defining a waste receiving cavity. Rotating the plate forces a portion of a waste water/slurry in the waste receiving cavity to back-flow into the food grinding cavity, to recycle/reuse the water. The fluid recovery member can include a fluid passageway oriented at an angle with respect to the plate. A control device can also be used to recycle the portion of the food waste water/slurry.

19 Claims, 8 Drawing Sheets

U.S. PATENT DOCUMENTS

| | | | |
|---|---|---|---|
| 2006/0144975 | A1 | 7/2006 | Anderson et al. |
| 2007/0084950 | A1 | 4/2007 | Hohl |
| 2007/0131808 | A1 | 6/2007 | Anderson et al. |
| 2007/0138327 | A1 | 6/2007 | Berger et al. |
| 2007/0194159 | A1 | 8/2007 | Berger et al. |

FOREIGN PATENT DOCUMENTS

| | | |
|---|---|---|
| KR | 20000000709 | 1/2000 |
| KR | 0245093 | 11/2001 |
| KR | 20020033935 | 5/2002 |
| KR | 20020065162 | 8/2002 |

* cited by examiner

WATER RECYCLING FOOD WASTE DISPOSER SYSTEM

CROSS-REFERENCE TO RELATED APPLICATIONS

This application claims the benefit of U.S. Provisional Application No. 60/901,184, filed on Feb. 13, 2007. The disclosure of the above application is incorporated by reference.

FIELD

The present disclosure relates to a device and method for recycling water during operation of a food waste disposer.

BACKGROUND

The statements in this section merely provide background information related to the present disclosure and may not constitute prior art.

Food waste disposers commonly have a motor driven mechanism that grinds food waste and combines a volume of water first to convert the ground food waste into a slurry and subsequently to transfer the slurry to a discharge area such as a drain pipe. Common systems use approximately 2 to 2.2 gallons per minute water flow during operation. The water system is directly connected, or a flow of water is provided to the waste disposer and the flow of water through the system is generally pass-through by design, the volume of water entering the waste disposer, mixing with the food waste, and the water and food waste as a slurry being directly discharged from the system.

In most countries, water supply is either limited or becoming more scarce and water cost is therefore becoming a significant factor to businesses, home owners or renters. In several countries of Asia, it is common to reduce the volume of water used to approximately 1 to 1.2 gallons per minute. Reducing the volume of water used in a given cycle with known waste disposers can reduce the efficiency of the waste disposer or result in difficulties in transferring the slurry to the waste receiving area. It is therefore desirable to provide a waste disposer that can operate effectively with a reduced total volume of input water in each cycle of operation both to conserve water and prevent discharge problems.

SUMMARY

According to several embodiments of a water recycling food waste disposer system of the present disclosure, a food waste disposer having a fluid recycling device includes a plate disposed for rotation within the food waste disposer. At least one fluid recovery member extends through the plate from a food grinding cavity to a waste receiving cavity. Rotation of the plate forces a portion of a food waste water/slurry mixture from the waste receiving cavity to the food grinding cavity through the fluid recovery member.

According to additional embodiments, a food waste disposer having a fluid recycling device includes a plate disposed for rotation within the food waste disposer having a surface operable to separate a disposer food grinding section from a disposer waste discharge section. At least one fluid passageway extends through the plate, the fluid passageway having at least one surface oriented at an angle with respect to the planar surface. Rotation of the plate forces a portion of a food waste water/slurry from the disposer waste discharge section to the food grinding section.

According to still further embodiments, a food waste disposer having a fluid recycling device includes a grinding section and a waste receiving section. A tube connected to the food waste transfers a water/slurry mixture. A control device recycles a portion of the water/slurry mixture back to the food waste disposer.

According to yet still further embodiments, a method is provided for recycling water in a food waste disposer, the food waste disposer having a plate disposed for rotation within the food waste disposer, a food grinding cavity, and a waste receiving cavity. The method includes rotating the plate to force a portion of a food waste water/slurry mixture from the waste receiving cavity to the food grinding cavity through a fluid recovery member that extends through the plate from the food grinding cavity to the waste receiving cavity.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
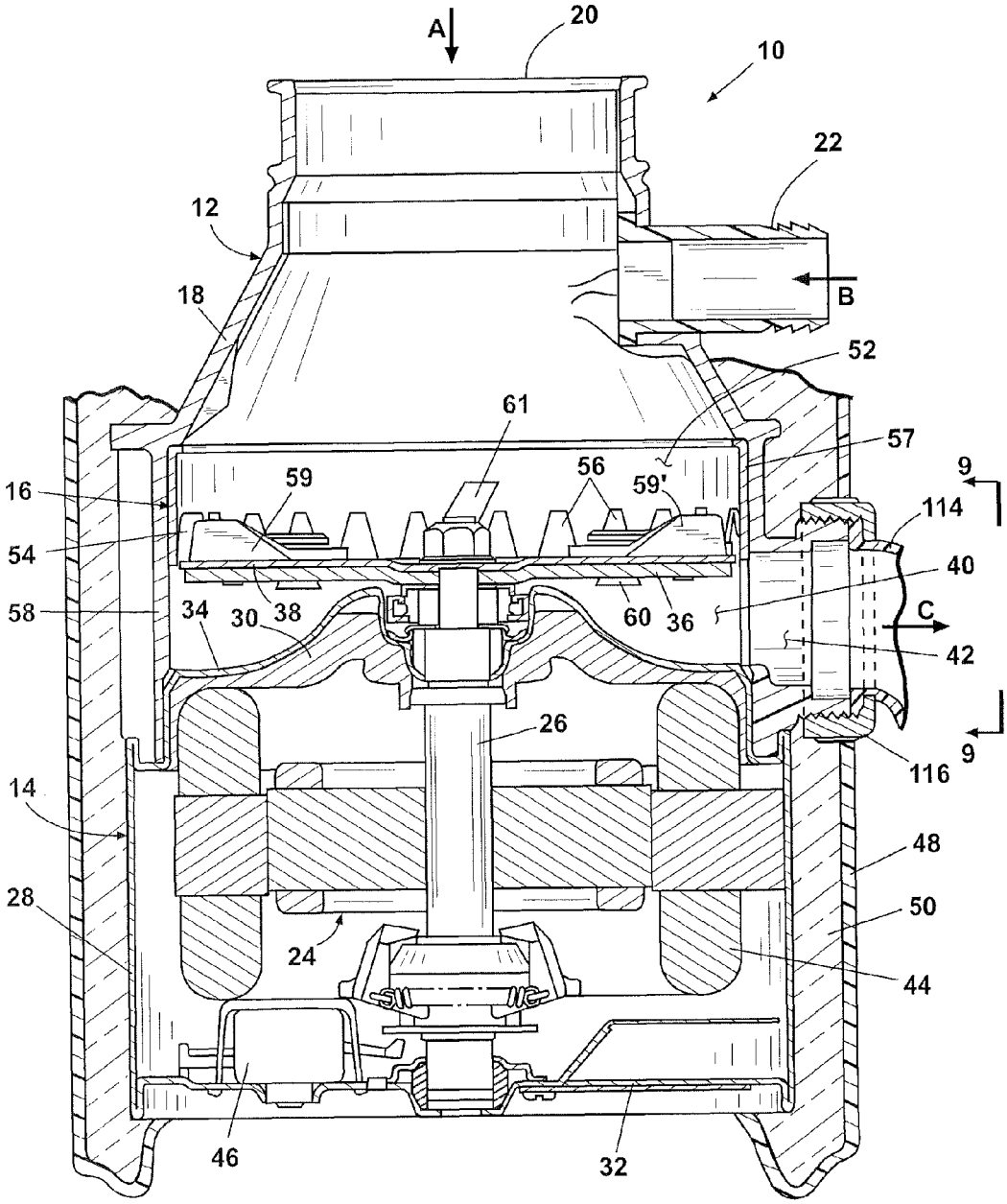
FIG. 1 is a cross-sectional side elevational view of a food waste disposer for a water recycling food waste disposal system of the present disclosure.

The following description is merely exemplary in nature and is not intended to limit the present disclosure, application, or uses. It should be understood that throughout the drawings, corresponding reference numerals indicate like or corresponding parts and features.

Figure 10:
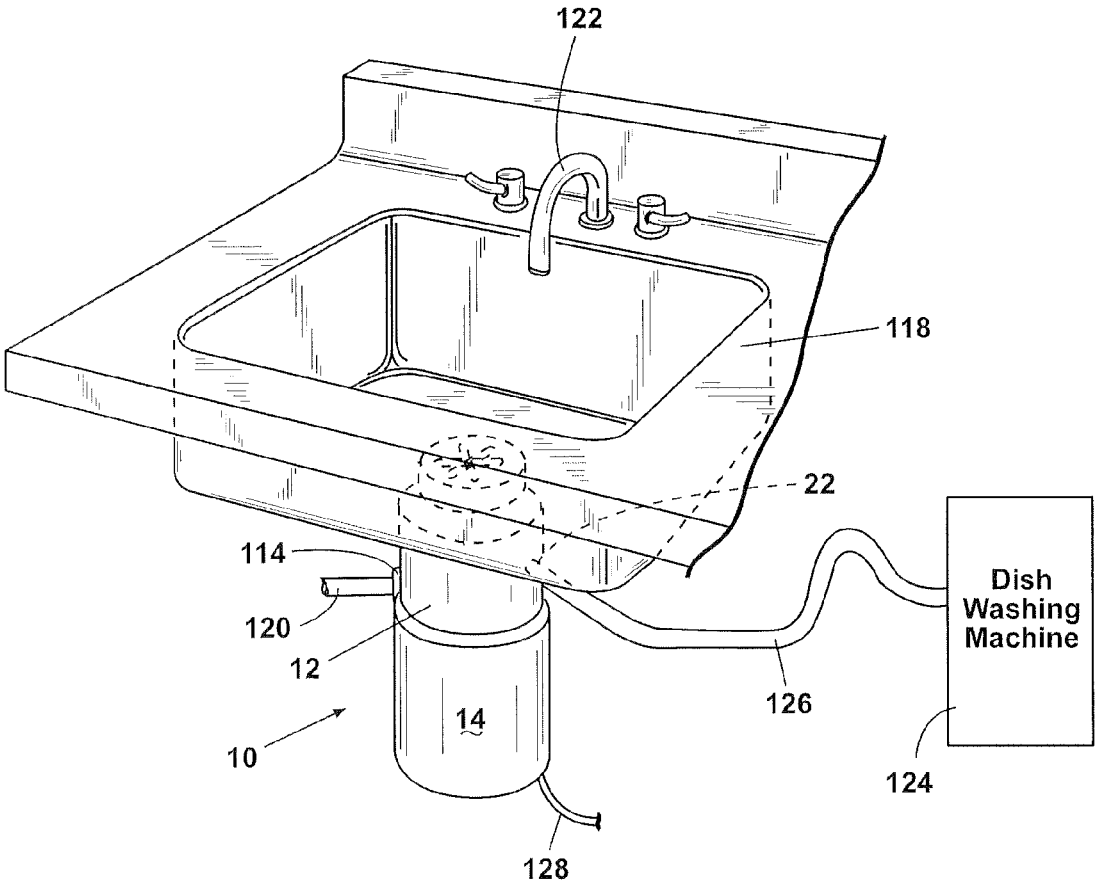
FIG. 10 is a partial perspective view of a water recycling food waste disposal system of the present disclosure.

Referring generally to FIG. 1, a food waste disposer 10 of the present disclosure includes an upper food conveying section 12, a lower motor section 14, and an intermediate grinding section 16 disposed between the food conveying section 12 and the motor section 14. The food conveying section 12 includes a housing 18 that forms an inlet 20 at its upper end for receiving food waste and water in a direction "A". The housing 18 also includes a second inlet 22 for receiving water and food waste in a direction "B" discharged from a dishwashing machine 124 (FIG. 10). Food conveying section 12 conveys food waste and water to the central grinding section 16.

The motor section 14 includes a motor 24 imparting rotational movement to a motor shaft 26, which may illustratively be an induction motor. The motor 24 is enclosed in a motor housing 28 having an upper frame 30 and a lower frame 32, either or both constructed of a metal such as aluminum, a polymeric material, or a composite material. According to several embodiments, a fluid seal 34 is provided which generally conforms to an upper surface shape of upper frame 30 and acts to prevent fluid or food waste from entering motor section 14. Fluid seal 34 can be made for example by a molding process from a polymeric material such as but not limited to polypropylene, polyamide, or the like.

The grinding section 16 can include a support plate 36 connected for rotation to motor shaft 26. Support plate 36 can be connected to a grinding or rotating plate 38. Water and ground food waste which are combined in a slurry are collected below support plate 36 and rotating plate 38 in a waste receiving cavity 40 for discharge in a discharge direction "C" through a discharge port 42. In several embodiments, rotating plate 38 is circular and is fastenably mounted to motor shaft 26. Rotating plate 38 can also be affixed to motor shaft 26 by swaging, welding, interference fit, or using other known affixation techniques.

Motor section 14 can further include windings 44 creating an induction field for motor 24. An electronic control section 46 can be provided which controls the operation of motor 24 such as operating speed, stalled or over-temperature shut-off, and the like. A trim shell or outer housing 48 can also be provided encasing one or more layers of acoustic insulation 50. According to several embodiments, outer housing 48 and acoustic insulation 50 are provided about both motor section 14 and food conveying section 12 for maximum sound attenuation.

Grinding section 16 has a grinding cavity 52 disposed above rotating plate 38 to receive the food waste and a volume of water. Food waste and the water volume can be received through inlet 20, through second inlet 22, or both. At least one and in several embodiments a plurality of fixed lugs or blades 54 extend upwardly from and co-rotate with rotating plate 38. Food waste is forced outwardly by centrifugal force toward blades 54 which force the food waste into contact with cutting edges or teeth defined by a plurality of apertures 56 in a stationary shredder ring 57. Stationary shredder ring 57 is fixed against an inner face of a support wall 58 to be stationary with respect to rotating plate 38. The food waste is ground between an outer edge of blades 54 and the cutting edges of apertures 56 and the ground food waste particles with the water in the form of a slurry moves downwardly as viewed in FIG. 1 through apertures 56 into waste receiving cavity 40.

To help transfer the food waste toward blades 54, at least one and in several embodiments a plurality of rotatable lugs 59 are provided (both a first lug 59 and a second lug 59' are shown), each connected to rotating plate 38 and/or support plate 36 using fasteners such as spin rivets 60. Spin rivets 60 (or a similar rotatable connector) allow lugs 59 to freely rotate with respect to rotating plate 38. Lugs 59 function to keep the food waste moving outwardly and therefore prevent accumulation of food waste in a stationary position with respect to rotating plate 38 out of reach of blades 54.

According to several embodiments at least one fluid recovery member or tube 61 is disposed in rotating plate 38 to fluidly connect waste receiving cavity 40 and grinding cavity 52. The rotational motion of rotating plate 38 and the shape and orientation of tube(s) 61 creates a difference in fluid pressure between waste receiving cavity 40 and grinding cavity 52. Due to this pressure differential, a portion of the slurry in waste receiving cavity 40 is drawn back up into grinding cavity 52. The portion of recovered slurry can vary depending on the size of tube(s) 61 and in several embodiments is approximately 20 to 25% of the volume of waste receiving cavity 40. The water portion of the returned slurry is therefore "recovered" and is available to help grind additional food waste in grinding cavity 52. The previously ground food waste particles of the returned slurry does not significantly reduce the grinding capability of disposer 10.

Figure 2:
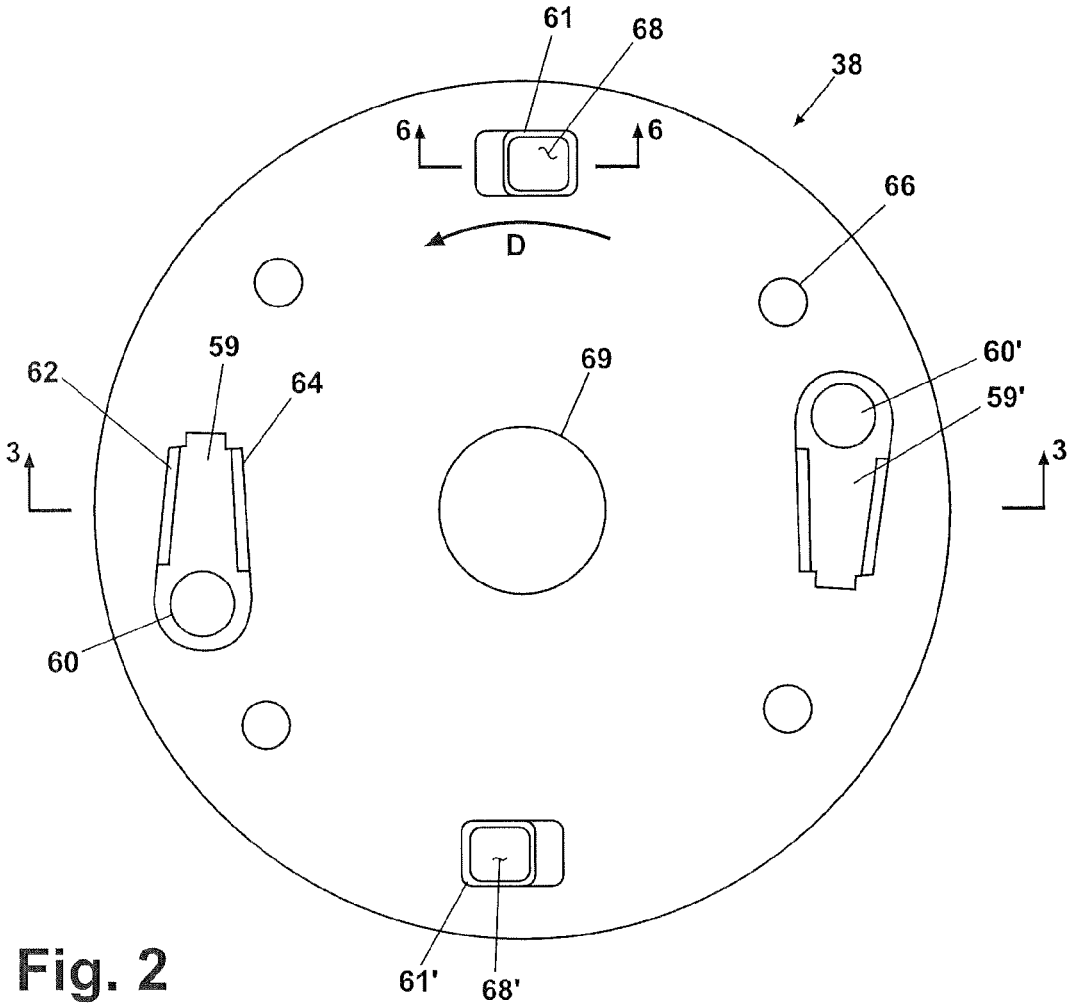
FIG. 2 is a top plan view of a rotating plate having fluid recovery tubes of the present disclosure.

Referring now to FIG. 2, an exemplary arrangement of rotatable lugs 59 and fluid recovery tubes 61 is shown. In the exemplary embodiment of FIG. 2, two fluid recovery tubes 61 are shown. It should be understood that there can be any number of fluid recovery tubes 61, including one. In the example shown, rotatable lugs 59, 59' are positioned approximately 180 degrees apart from each other and approximately 90 degrees from each of the recovery tubes 61 which are positioned in opposed relationship. Each of the rotatable lugs 59 includes a first and second wing 62, 64 which help propel food waste outwardly due to the rotating motion of rotating plate 38. At least one and in several embodiments a plurality of drain holes 66 extend through rotating plate 38 and support plate 36 (if used) which allow a remaining volume of water or slurry in grinding cavity 52 to drain by gravity into waste receiving cavity 40 after rotation of rotating plate 38 stops.

Figure 3:
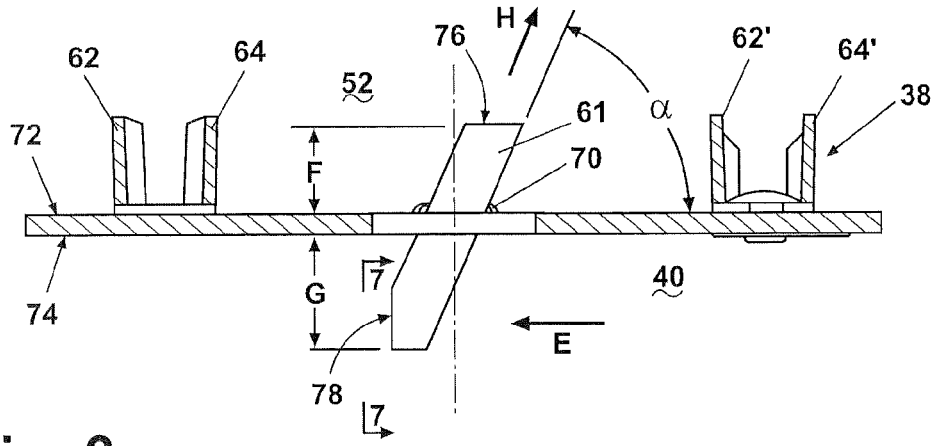
FIG. 3 is a cross-sectional side elevational view of the rotating plate of FIG. 2, taken along line 3-3 of FIG. 2.

As best seen in reference to both FIGS. 2 and 3, fluid recovery tubes 61, 61' each define a fluid recovery passage 68, 68'. Fluid recovery passages 68, 68' are continuously open between waste receiving cavity 40 and grinding cavity 52. A motor shaft receiving aperture 69 is also provided in rotating plate 38. In the embodiment shown, fluid recovery tubes 61, 61' are fixedly attached using a weld joint 70 to an upper surface 72 of rotating plate 38 and define an angle $\alpha$ with respect to upper surface 72. Angle $\alpha$ can be any angle ranging from approximately 5 degrees to approximately 85 degrees, and according to several embodiments is selected from an angle within a range from approximately 30 to 50 degrees. Rotating plate 38 rotates in a predetermined direction, and in the embodiment of FIG. 2 rotation is counterclockwise defining a direction of rotation "D". A first portion of each fluid recovery tube 61 can terminate co-extensive with or extend above plate upper surface 72 to define a discharge end 76. A second portion of each fluid recovery tube 61 extends below plate lower surface 74 and includes an inlet end 78. Based on direction of rotation "D", fluid recovery tube 61 at the top of FIG. 3 moves in travel direction "E" and due to angle $\alpha$ inlet end 78 defines a leading edge which can be oriented substantially perpendicular to lower surface 74. Inlet end 78 therefore acts to scoop water and the slurry from waste receiving cavity 40. Water/slurry mixture flow is also induced in part due to a higher fluid pressure at inlet end 78 compared to discharge end 76, which can increase as angle $\alpha$ increases, and as a rotational speed of rotating plate 38 increases.

To maximize flow of fluid through fluid recovery tubes 61 and minimize the potential for cavitation noise, in several embodiments discharge end 76 of each fluid recovery tube 61 defines an outlet face oriented substantially parallel to upper surface 72. The upper portion of tube 61 at discharge end 76 can be flush with or extend above upper surface 72 by a dimension "F", and the lower portion of tube 61 at inlet end 78 extends below lower surface 74 by a dimension "G". Dimensions "F" and "G" can vary, particularly with respect to the dimensions of inlet end 78 and fluid recovery passage 68, and are generally limited by the depths of grinding cavity 52 and waste receiving cavity 40. Flow emerging from discharge end 76 is initially traveling in a direction "H" which varies directly with angle α. The discharged fluid is then dispersed outwardly due to centrifugal acceleration. Dimension "F" can vary from zero, when discharge end 76 is approximately flush with upper surface 72, to the maximum height available in grinding cavity 52, however, testing indicates that a reduced or zero value for dimension "F" further prevents food waste from adhering to fluid recovery tube 61 or being propelled upward away from blades 54. When distance "F" is zero or approximately zero, weld joint 70 can be positioned below rotating plate 38.

Figure 4:
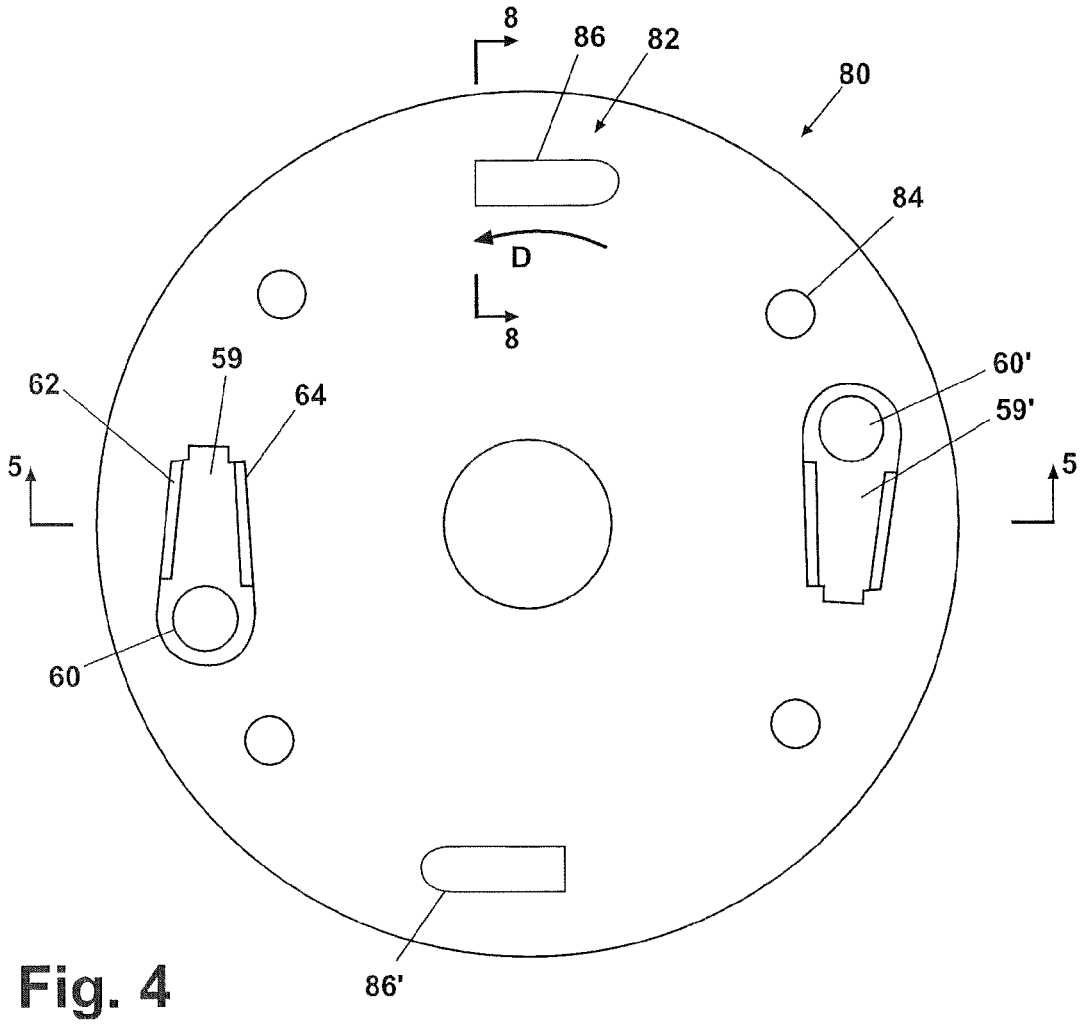
FIG. 4 is a top plan view of a rotating plate similar to FIG. 2 showing a different embodiment of fluid recovery members of the present disclosure.
Figure 5:
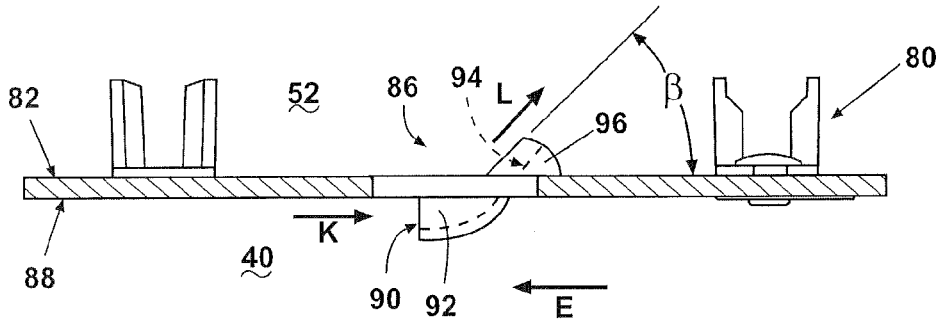
FIG. 5 is a cross-sectional side elevational view of the rotating plate of FIG. 4, taken along line 5-5 of FIG. 4.

Referring now to FIGS. 4 and 5, in other embodiments of the present disclosure, the separately connected recovery tubes 61 can be replaced by similarly functioning members which are created by a stamping, drawing, or molding process from the material of a rotating plate 80. Rotating plate 80, similar to rotating plate 38, can include an upper surface 82 having one or more rotatable lugs 59 connected thereto by fasteners such as spin rivets 60, and one or more drain holes 84 similar to drain holes 66. Rotating plate 80 includes at least one and in several embodiments a plurality of fluid recovery members 86 (two fluid recovery members 86, 86' are shown) which are similarly formed. Similar to rotating plate 38, rotating plate 80 is adapted to rotate in a predetermined direction, such as direction of rotation "D" which results in motion of fluid recovery member 86 in travel direction "E".

As best seen in reference to FIG. 5, each fluid recovery member 86 is formed by displacing a portion of rotating plate 80 away from or spaced with respect to a lower surface 88. In several embodiments, each fluid recovery member 86 can also be created by displacing a portion of rotating plate 80 away from or spaced with respect to upper surface 82. A fluid recovery inlet 90 is created below lower surface 88 at the end of an extending wall portion 92. A substantially smooth fluid transfer surface 94 is created from fluid recovery inlet and extending to a wall extension 96 created above upper surface 82. Similar to fluid recovery tubes 61, water and slurry from waste receiving cavity 40 enter fluid recovery inlet 90 in an inlet flow direction "K", are directed along the path defined by fluid transfer surface 94, and discharge above upper surface 82 into grinding cavity 52 in a discharge direction "L". Wall extension 96 and fluid transfer surface 94 define an angle β with respect to upper surface 82. Angle β can be any angle within the range previously specified for angle α of FIG. 3. Fluid recovery members 86 can be similarly positioned about rotating plate 80 as fluid recovery tubes 61 are positioned. Fluid recovery members 86 can be formed using any one or more of a drawing, punching, stamping, coining, molding, or similar processes from material of rotating plate 80. A distance of extending wall 92 extending below lower surface 88 and a distance of wall extension 96 above upper surface 82 when a drawing process is used are substantially controlled by the originally selected thickness of rotating plate 80.

Figure 6:
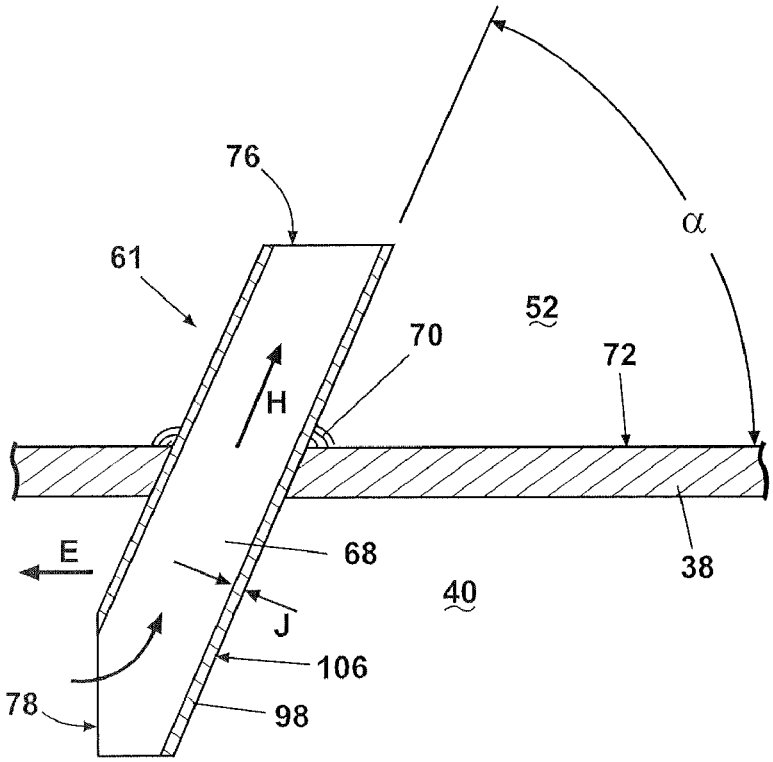
FIG. 6 is a cross-sectional view of the fluid recovery tube taken at section 6 of FIG. 2, taken along line 6-6 of FIG. 2.
Figure 7:
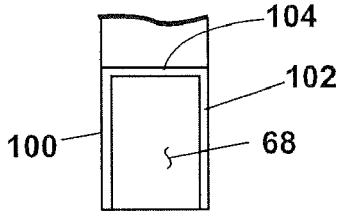
FIG. 7 is a partial end elevational view of the fluid recovery tube of FIG. 2 and FIG. 3 taken along line 7-7 of FIG. 3.

Referring now to FIGS. 6 and 7, fluid recovery tubes 61 can be rectangular in cross-section as shown, or can also be other geometric shapes such as but not limited to square, circular, oval, and other polygonal shapes. A tube wall thickness "J" of a tube wall 98 can vary to suit the desired cross section of fluid recovery passage 68, and/or the requirements for welding or otherwise fixedly connecting fluid recovery tubes 61 to rotating plate 38. Food waste disposers 10 of the present disclosure are not limited by the shape of fluid recovery tubes 61. Tube 61 in the exemplary rectangular shape shown includes first and second side walls 100, 102 and a tube lead wall 104 acting as lead faces of tube 61 in travel direction "E". Fluid entering inlet end 78 is redirected by a tube trailing wall 106 toward the fluid discharge direction "H".

Figure 8:
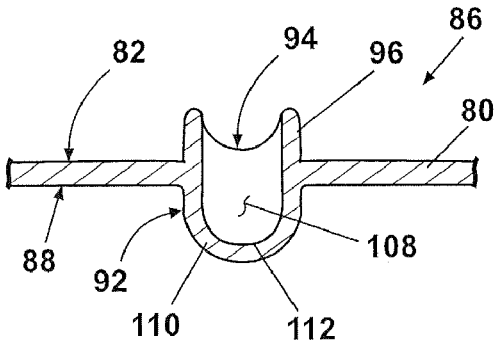
FIG. 8 is a cross-sectional end elevational view of the fluid recovery member of FIG. 4, taken along line 8-8 of FIG. 4.

Referring now to FIG. 8, an exemplary geometry of recovery members 86 includes a generally U-shaped fluid recovery passage 108 defined by fluid transfer surface 94. Fluid enters fluid recovery passage 108 at an inlet face 110 defining a curved passage wall 112 of extending wall 92 created below lower surface 88. The shape of fluid recovery passage 108 is not limited to the U-shape shown, but can also be rectangular, oval, circular, V-shaped, and the like at the discretion of the designer.

Figure 9:
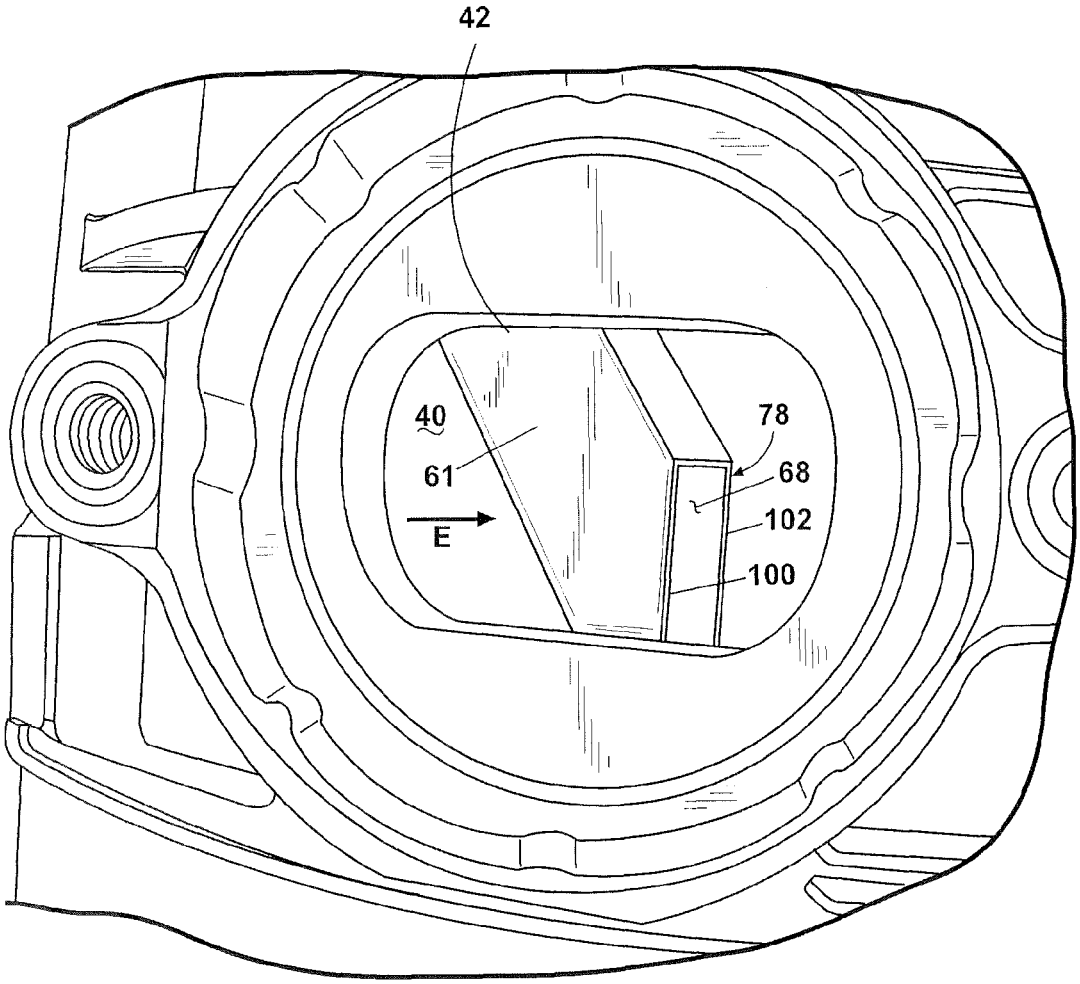
FIG. 9 is a side elevational view at area 9 of FIG. 1.

As best seen in FIG. 9, the location of the leading face or inlet end 78 of fluid recovery passage 68 can be oriented with respect to discharge port 42 so that a portion of water/slurry aligned for discharge from disposer 10 can be recovered. The position of inlet end 78 can also be raised or lowered from that shown within the constraints of waste receiving cavity 40. Inlet end 78 can also be cleaned if necessary by disconnection of any discharge fitting from discharge port 42. A further benefit of the orientation and design of inlet end 78 is its passage through waste receiving cavity 40 proximate to discharge port 42. Inlet end 78 is capable of removing or clearing food waste such as food strands that bypass the interface of blades 54 and the cutting edges or teeth created by apertures 56. This food waste can otherwise build up in the area of discharge port 42. Inlet ends 78 of fluid recovery tubes 61 can therefore provide a "self cleaning" feature for disposer 10.

With further reference to FIG. 1, during operation of food waste disposer 10, food waste delivered by the food conveying section 12 to the grinding section 16 is forced by rotatable lugs 59 and blades 54 against teeth created by apertures 56 of shredder ring 57. The teeth grind the food waste into particulate matter sufficiently small to pass from above (as shown in FIG. 1) the grinding or rotating plate 38 to below rotating plate 38. Due to gravity, the particulate matter that passes through apertures 56 drops onto the polymeric fluid seal 34 above upper frame 34 and, along with the volume of water injected into disposer 10 to create a water/waste slurry, is discharged through discharge port 42 into a tailpipe 114. A fluid-tight seal is formed where support wall 58 and fluid seal 34 meet. Tailpipe 114 can be connected to the discharge port 42 by a plumbing nut 116. Other exemplary ways to connect a food waste disposer to a tailpipe 114 are recited in U.S. Pat. No. 6,007,006 (Engel et al.) co-owned by the assignee of the present design, the subject matter of which is incorporated herein by reference.

The shredder ring 57, which includes the plurality of spaced apertures 56, can also be fixedly attached to an inner surface of support wall 58 by an interference fit and can be composed of galvanized steel or other metallic material such as stainless steel. The shredder ring 57 can also be made of non-metallic material such as polymeric or composite material. The shredder ring 57 can also be formed into the support wall 58 by molding or machining techniques. The support wall 58 can further be an injection-molded plastic, or made of a metal such as powdered metal or steel, or made by casting methods such as die-casting or investment casting. The use of injection-molded plastic allows support wall 58 to be resistant to corrosion from contact with shredder ring 57. The present disclosure, however, is not limited to housings made of injection-molded plastic.

With continuing reference to FIG. 1, rotating plate 38 and support plate 36 can also be replaced by a single piece assembly to reduce the complexity of the manufacturing process and increase the integrity of the grinding mechanism. The rotating plate 38 and support plate 36, alternatively, can be attached by mechanical connectors (such as welds or rivets) or by an adhesive. Attaching the components reduces relative movement between the two components and minimizes the number of parts to be handled during final assembly.

Rotating plate 38 (and rotating plate 80) can be made from a flat sheet of metal that is stamped or otherwise formed into shape. Alternatively, rotating plates 38 and 80 can be formed by powdered metal methods, by injection molding methods such as insert plastic injection molding, metal injection molding, or by casting methods such as die-casting or investment casting. Rotating plate 38 in several embodiments has a thickness ranging from about 0.040 inch to about 0.100 inch thick. In several embodiments, rotating plates 38 and 80 are composed of double-sided galvanized cold-rolled steel and have a thickness of about 0.071 inch. Rotating plates 38 and 80 can also be composed of other metallic materials such as stainless steel, powdered metal or casting material, or non-metallic material such as plastic.

The stationary shredder ring 57 can be formed from stamping methods, powdered metal methods, injection molding methods such as insert plastic injection molding or metal injection molding, or casting methods such as die-casting or investment casting. When composed of stamped metal, the stationary shredder ring 57 in several embodiments has a thickness ranging from about 0.030 inch to about 0.090 inch thick. According to several embodiments, stationary shredder ring 57 is composed of double-sided, galvanized, cold-rolled steel and has a thickness of about 0.055 inch. The stationary shredder ring 57 can also be made of other metallic material such as stainless steel, or non-metallic material such as plastic. The apertures 56 can be provided with different shapes as required to grind food particles of different sizes or densities. An exposed height of apertures 56 above the upper surface 72 of rotating plate 38 in several embodiments ranges from about 0.180 inch to about 0.350 inch.

Referring now to FIG. 10, in an exemplary installation food waste disposer 10 is mounted to a sink 118. A volume of water is used to create a waste/water slurry which enhances discharge of the ground waste particles to a drain pipe 120 or other discharge location. The source of water can be a faucet assembly 122, the volumetric flow rate of which is manually controlled, or the water can be supplied along with the food waste from a dish washing machine 124 through a dishwasher discharge line 126 connected to the second inlet 22 for subsequent grinding by disposer 10. Electrical power for motor 24 is provided through an electrical power cord 128.

Figure 11:
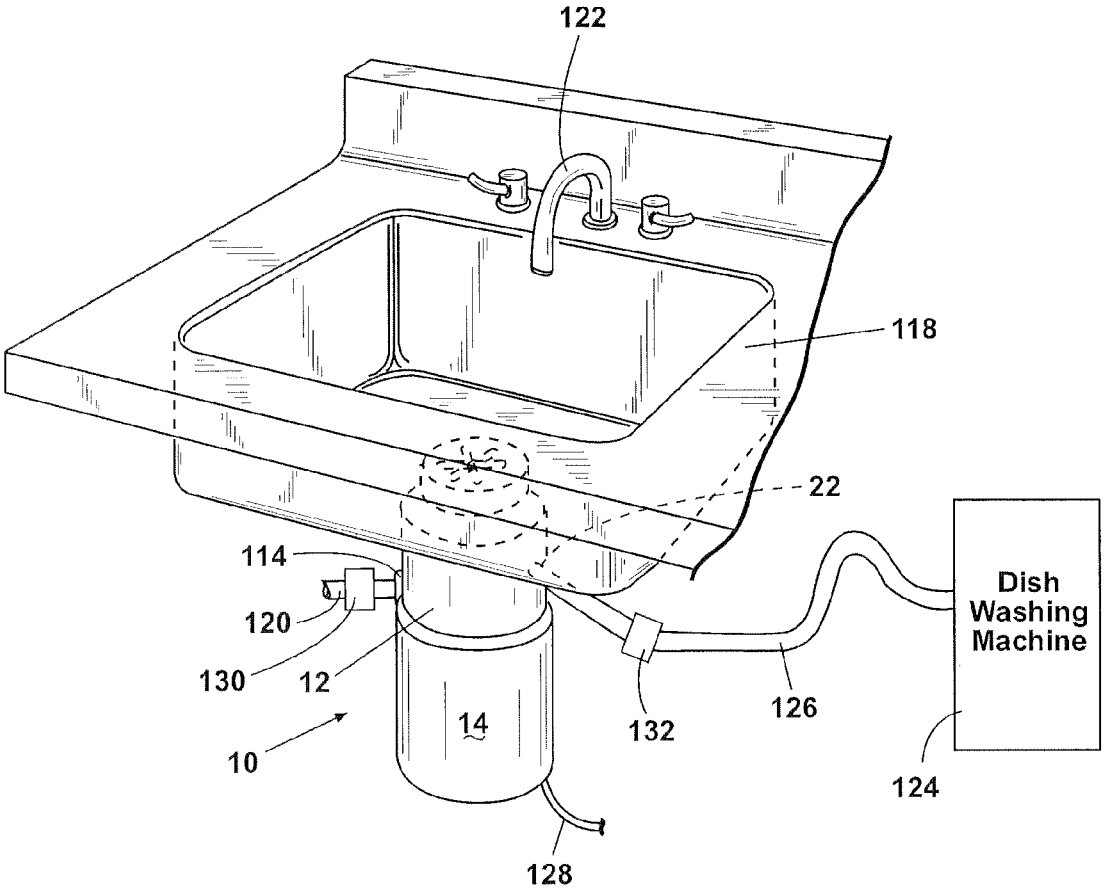
FIG. 11 is the partial perspective view of FIG. 10 further showing multiple flow control devices.

Referring now to FIG. 11, in additional embodiments of the present disclosure recovery of water for food waste disposer 10 can also be controlled by the use of one or more control devices, including a discharge flow control device 129 (such as a flow control device or pressure switch) positioned in tailpipe 114 or drain pipe 120, or a discharge flow control device 130 (such as a flow control device or pressure switch) in dishwasher discharge line 126. Devices 129 and 130 can operate in several ways: 1) to reduce a fluid/slurry discharge rate and thereby reduce total water volume used in the operation; 2) to signal operation of food waste disposer 10 when a flow rate or fluid pressure is detected for example in dishwasher discharge line 126; or 3) as flow diverter devices which divert a portion of the fluid/slurry discharged through tailpipe 114 to be diverted back to waste receiving cavity 40 of food conveying section 12 through a separate flow path.

The control device operable as discharge flow control device 130 can be positioned contact with a tube surface or in fluid communication with the water/slurry mixture and is operable to start food waste disposer 10 upon receipt of a signal indicating presence of the water/slurry mixture in dish washer discharge line 126 from dish washing machine 124. The control device 129 operable for example as a discharge flow control switch can be positioned in contact with the tube or in fluid communication with fluid in the tube defining a waste disposer discharge tube operable to receive the water/slurry mixture discharged from food waste disposer 10. The control device 129 is operable to control operation such as shutting off the food waste disposer upon receipt of a signal indicating lack of flow of the water/slurry mixture or to open a flow device which recycles a portion of the water/slurry mixture back to the disposer 10.

In several embodiments, a separate pump 131 can also be used in conjunction with one of more of the control devices 129, 130 to direct a return flow of a portion of the water/slurry mixture back to the food waste disposer 10. Discharge from pump 131 can be routed through a tube 132 which can connect directly to second inlet 22 if a dish washing machine 124 is not connected, or can connect into dish washer discharge line 126 with a backflow prevention device 133 in place such as a check valve to prevent back flow toward the dish washing machine 124. Water/slurry mixture discharge from disposer 10 can also be directly returned to the grinding section 16 through tube 132 without the use of pump 131. Any of the control devices 129 or 130, or pump 131 can also be electrically connected to electronic control section 46 to turn disposer 10 and/or pump 131 on or off.

An example of a device that can be used for flow control switch 129 is the FX Series Electronic Flow Control Switch available from Ameritrol, Inc. Instruments and Controls, of Vista, Calif. Examples of devices that can be used for flow control device 130 include Ultrasonic flow sensors, such as Flow Sensor ABB U2500 available from the ABB Group, Asea Brown Boverri Ltd, Zurich, Switzerland; and inline flow meters such as inline flow meter model FV100 from Omega Engineering, Inc.

Figure 12:
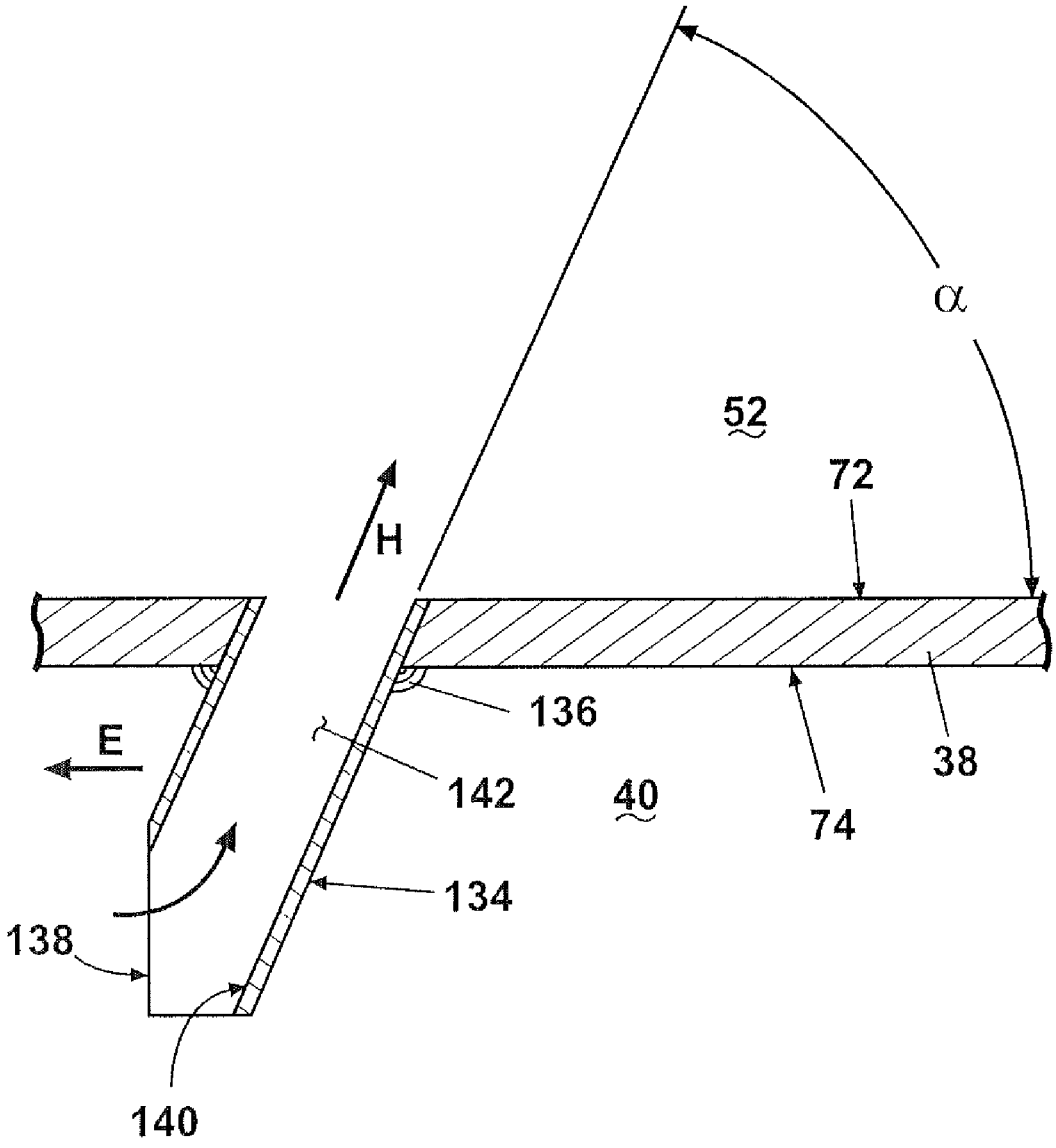
FIG. 12 is a cross-sectional view similar to FIG. 6 of another embodiment of a flow control device of the present disclosure.

Referring now to FIG. 12, according to another embodiment of the present disclosure, a fluid recovery tube 134 is modified from fluid recovery tube 61 to end substantially at or flush with upper surface 72 of rotating plate 38. A weld joint 136 in place of weld joint 70 can be provided to join fluid recovery tube 134 to plate lower surface 74. A tube inlet end 138 acts as the lead face of tube 134 in travel direction "E". Fluid entering inlet end 138 is redirected by a tube trailing wall 140 into a fluid recovery passage 142 which directs fluid flow toward the fluid discharge direction "H". Similar to fluid recovery tube(s) 61, one or more fluid recovery tube(s) 134 can be used and each is oriented at angle $\alpha$ with respect to upper and lower surfaces 72, 74.

Additional features can also be provided to assist in transfer and efficient processing of the food waste. These features can include tumbling spikes, diverters, and breakers disclosed in U.S. Pat. No. 6,439,487 to Anderson et al., co-owned by the assignee of the present application, the subject matter of which is incorporated herein by reference.

The water recycling food waste disposer system of the present disclosure provides several advantages. By directing a portion of the water/slurry that would otherwise be directly discharged, back to the grinding section of the disposer, the water in the recycled portion can be further used for additional food waste treatment. By orienting flow recovery tubes or flow members at a predetermined angle through the rotating plate of the grinding section, the rotational speed of the rotating plate generates the necessary differential pressure to return the portion of water/slurry without the need of additional pumps or equipment. The volume of recycled fluid/slurry can be predetermined by the size, depth, and quantity of the flow recovery tubes or flow members. Some consumers use warm or hot water and some also use soap or other chemicals to freshen the disposer during and after grinding. By having the food waste disposer controlled for use only while the dishwasher is discharging reclaims used soapy water that has been heated to better clean and sanitize the disposer both while grinding and after. The reclaimed water can be used for grinding with no increased cost. A further advantage of recycling a portion of the water/slurry mixture is that additional grinding can occur which can further reduce the particle size that assists in discharging the slurry.

What is claimed is:

1. A food waste disposer having a fluid recycling device, comprising:

a food grinding cavity operable to generate during operation of the food waste disposer a food waste/water slurry mixture from food waste received into the food grinding cavity of the food waste disposer as the food waste disposer is operating and from water received into the food grinding cavity as the food waste disposer is operating from a source of water external to the food waste disposer;

a barrier separating the food grinding cavity from a waste receiving cavity of the food waste disposer wherein the waste receiving cavity is disposed below the food grinding cavity and receives the waste/water slurry mixture discharged from the food grinding cavity;

a discharge port in fluid communication with the waste receiving cavity through which the waste/water slurry mixture received in the waste receiving cavity is discharged during operation of the food waste disposer; and a fluid recycling device in fluid communication with the food grinding cavity through the barrier such that a portion of the waste/water slurry mixture received in the waste receiving cavity during operation of the food waste disposer is returned during operation of the food waste disposer to the food grinding cavity through the fluid recycling device to reduce an amount of water needed to be received into the food grinding cavity from the external source during operation of the food waste disposer to generate the food waste/water slurry mixture.

2. The food waste disposer of claim 1, wherein the barrier further comprises a plate disposed for rotation within the food waste disposer.

3. The food waste disposer of claim 2, wherein the fluid recycling device includes at least one fluid transfer member oriented at an angle with respect to the plate providing fluid communication through the plate from the food grinding cavity to the waste receiving cavity, wherein rotation of the plate is operable to force the portion of the waste/water slurry mixture from the waste receiving cavity to the food grinding cavity through the fluid transfer member.

4. The food waste disposer of claim 2, wherein the fluid recycling device comprises a tubular member fixedly connected to the plate, the tubular member having an internal passageway for transfer of the waste/water slurry mixture.

5. The food waste disposer of claim 4, wherein the tubular member is oriented at an angle ranging from approximately 5 degrees to approximately 85 degrees with respect to the plate.

6. The food waste disposer of claim 2, wherein the fluid recycling device comprises a tubular member fixedly connected to the plate, the tubular member including an inlet defining a leading edge oriented substantially perpendicular to the plate, the leading edge positioned to pass proximate to a discharge opening of the food waste disposer as the plate and the tubular member co-rotate to provide for self cleaning of the discharge opening.

7. The food waste disposer of claim 6, wherein the tubular member includes an outlet defining a discharge face oriented substantially parallel to the plate.

8. The food waste disposer of claim 3, wherein the fluid transfer member includes a fluid transfer surface defining a generally U-shaped fluid recovery passage extending into the waste receiving cavity.

9. The food waste disposer of claim 3, wherein the fluid transfer member includes a fluid transfer surface defining a portion of a geometric shape selected from one of a rectangular shape, an oval shape, a circular shape, and a V-shape.

10. The food waste disposer of claim 3, wherein the fluid transfer member further includes:

a fluid transfer surface having a portion extending away from at least a lower surface of the plate; and a fluid recovery inlet formed at an end of an extending wall portion.

11. The food waste disposer of claim 10, wherein the angle ranges from approximately 5 degrees to approximately 85 degrees with respect to the lower surface.

12. The food waste disposer of claim 3, wherein the fluid recovery member is a displaced portion of the plate.

13. A food waste disposer having a fluid recycling device, comprising:

a plate disposed for rotation within the food waste disposer having a substantially planar surface operable to separate a disposer food grinding section from a disposer waste discharge section wherein the disposer waste discharge section is disposed below the disposer food grinding section;

a food waste/water slurry mixture generated in the food grinding section while the plate is rotating from food waste received into the food grinding section while the plate is rotating and water received into the food grinding section while the plate is rotating from an external source, the food waste/water slurry mixture being discharged into the disposer waste discharge section while the plate is rotating; and at least one fluid passageway member extending through the plate, the fluid passageway member having at least one surface oriented at an angle with respect to the planar surface such that rotation of the plate is operable to force a portion of a food waste/water slurry from the disposer waste discharge section to the food grinding section to reduce the amount of water needed to be received into the food grinding section from the external source of water while the plate is rotating to generate the food waste/water slurry mixture.

14. The food waste disposer of claim 13, wherein the angle ranges from approximately 5 degrees to approximately 85 degrees with respect to the planar surface.

15. The food waste disposer of claim 13, wherein the at least one fluid passageway member includes at least one tubular member fixed to the plate.

16. The food waste disposer of claim 15, wherein the at least one tubular member includes:

a first portion extending into the food grinding section; and a second portion extending into the waste discharge section.

17. The food waste disposer of claim 13, including at least one fluid recovery member formed as a portion of the plate displaced to extend away from the plate.

18. The food waste disposer of claim 17, wherein the fluid recovery member includes a generally U-shaped surface for the at least one fluid passageway.

19. The food waste disposer of claim 17, wherein the displaced portion of the plate extends away from each of first and second opposed sides of the plate.

* * * * *